United States Patent [19]

Goikhman et al.

[11] Patent Number: 5,004,056

[45] Date of Patent: Apr. 2, 1991

[54] PERCUSSION-ROTARY DRILLING TOOL

[76] Inventors: Yakov A. Goikhman, ulitsa Gladkova, 14, kv. 49, Krasnoyarsk; Georgy M. Krjukov, ulitsa 2 Sinichkina, 11, kv. 145, Moscow; Melis I. Onotsky, ulitsa Pavla Andreeva, 28, kv. 332, Moscow; Georgy M. Sorokin, Leninsky prospekt, 67, korpus 2, kv. 334, Moscow; Alexei V. Filatov, ulitsa Startovaya, 31, kv. 51, Moscow; Viktor V. Tsarapkin, Leninsky prospekt, 91, kv. 351, Moscow; Vadim P. Yakimov, ulitsa Gilyarovskogo, 36, kv. 74, Moscow; Gennady A. Smirnov, ulitsa Partizana Zheleznyaka, 24, kv. 6, Krasnoyarsk; Ivan I. Nikiforov, ulitsa 60-letia Oktyabrya, 44, kv. 74, Krasnoyarsk; Alexandr I. Burdukovsky, ulitsa Schorsa, 50, kv. 32, Krasnoyarsk; Sergei V. Dailbov, ulitsa Ju. Ichevoi, 193, kv. 83, Kyshtym; Alexandr S. Kurdjukov, ulitsa K. Libknekhta, 117, kv. 3, Kyshtym, all of U.S.S.R.

[21] Appl. No.: 455,367

[22] PCT Filed: Dec. 28, 1988

[86] PCT No.: PCT/SU88/00285

§ 371 Date: Jan. 23, 1990

§ 102(e) Date: Jan. 23, 1990

[87] PCT Pub. No.: WO89/11580

PCT Pub. Date: Nov. 30, 1989

[30] Foreign Application Priority Data

May 23, 1988 [SU] U.S.S.R. ..... 4429566
Nov. 18, 1988 [SU] U.S.S.R. ..... 4603481

[51] Int. Cl.[5] ..... E21B 10/40; E21B 10/62

[52] U.S. Cl. ..... 175/293; 175/381; 175/382; 175/415; 175/417; 175/413

[58] Field of Search ..... 175/293, 296, 379, 381, 175/382, 405, 410, 414, 413, 415, 417, 418

[56] References Cited

U.S. PATENT DOCUMENTS

| | | | |
|---|---|---|---|
| 2,464,781 | 3/1949 | Baker | 175/415 |
| 2,815,932 | 12/1957 | Wolfram | 175/293 |
| 4,386,669 | 6/1983 | Evans | 175/381 |
| 4,765,419 | 8/1988 | Scholz et al. | 175/415 |
| 4,883,133 | 11/1989 | Fletcher et al. | 175/414 |

FOREIGN PATENT DOCUMENTS

| | | | |
|---|---|---|---|
| 0054721 | 6/1982 | European Pat. Off. . | |
| 284918 | 1/1971 | U.S.S.R. . | |
| 740947 | 6/1980 | U.S.S.R. | 175/414 |
| 985240 | 1/1983 | U.S.S.R. . | |
| 1314038 | 5/1987 | U.S.S.R. . | |

*Primary Examiner*—Bruce M. Kisliuk
*Attorney, Agent, or Firm*—Ladas & Parry

[57] ABSTRACT

The proposed tool comprises a body (1) designed to interact with a percussion-rotary device and a casing (2) shaped as a sleeve. The casing (2) accommodates rock-crushing elements (5, 6) arranged in a manner allowing axial displacement thereof and in the form of concentric rows relative to a working end of the casing (2), the rock-crushing elements having shanks (7, 8) which interact with the body (1). Each rock-crushing element (6) in a peripheral row comprises a spring biased pin mechanism (16) for fixing the rock-crushing element (6) in the casing (2). The casing includes a threaded joint (9) for its axial displacement relative to the body (1). The length of axial displacement of the casing (2) relative to the body (1) is at least equal to the length (H) of the wearable portion of the rock-crushing elements (5, 6).

9 Claims, 3 Drawing Sheets

PERCUSSION-ROTARY DRILLING TOOL

TECHNICAL FIELD

The present invention relates to drilling equipment and in particular to a percussion-rotary drilling tool.

The tool according to the invention may be used to best advantage for drilling blast and prospecting holes and oil wells in highly abrasive hard rock.

BACKGROUND ART

There is known a percussion-rotary drilling tool (cf. SU, A, 284, 918) comprising a body designed to interact with a percussion-rotary device and a casing in the form of a sleeve. The casing accommodates rock-crushing elements representing concentric rings and arranged in a manner allowing axial displacement thereof. Said elements include shanks interacting with the body. The casing comprises means enabling its axial displacement with respect to the body. Both the body and the casing have at least one through channel to pass a working medium used for removing slime from the borehole.

The known tool is suitable for drilling holes in low- and medium-abrasive rock. However, the use of such a tool in highly abrasive rock presents a difficulty for rock-crushing elements wear out rapidly due to a limited length of its wearable portion and absence of requisite means to compensate for wear of said rock-crushing elements, a disadvantage resulting in low durability of the tool.

DISCLOSURE OF THE INVENTION

The object of the invention is to create a percussion-rotary drilling tool wherein the construction of rock-crushing elements and proper length of axial displacement of a casing relative to the body would ensure a greater length of the wearable portion of the rock-crushing elements in drilling and, in effect, increase durability and effectiveness of the proposed tool.

This object is accomplished by that in a percussion-rotary drilling tool comprising a body designed to interact with a percussion-rotary device and having at least one through channel to pass a working medium used for removing slime from a borehole and a casing shaped as a sleeve and accommodating rock-crushing elements representing concentric rings and arranged in a manner allowing axial displacement thereof, which have shanks interacting with the body, said casing including means for its axial displacement with respect to the body and having at least one through channel to pass a working medium used for removing slime from a borehole, wherein, according to the invention, each rock-crushing element in a peripheral ring comprises a means for fixing it in the casing and the length of axial displacement of the casing relative to the body is at least equal to the length of the wearable portion of the rock-crushing element.

Advantageously annular grooves are provided on the lateral surface of the shank of each rock-crushing element in a peripheral ring, while the means for fixing said rock-crushing element comprises a spring-loaded retaining element interacting with said annular groove and disposed in a blind cavity within the casing, which is in communication with a peripheral channel accommodating said rock-crushing element.

This prevents the rock-crushing elements in a peripheral ring from falling out to the full length of the wearable portion in running the tool in and out of the borehole. Hence, the proposed tool will not be jammed in the borehole.

It is preferable that the distance between adjacent annular grooves on the lateral surface of the shank of the rock-crushing element should be chosen with due regard for the following relationship:

$$L = (0.8 - 1.0)\frac{R_1 - R_2}{\cos\alpha}$$

where $R_1$=radius of percussion-rotary drilling tool, m;

$R_2$=casing radius, m; and $\alpha$=angle of inclination of each rock-crushing element in peripheral ring towards end face of casing on the side of crushed rock, $\alpha$=45° to 89°.

The upper limit of the angle $\alpha$ of inclination of the rock-crushing element in a peripheral ring ($\alpha$=89°) is chosen to obtain a desired gap between the borehole wall and the proposed tool so that the tool is not jammed in the borehole. The lower limit ($\alpha$=45°) is chosen with due regard for design considerations and conditions enabling maximal transmission of impact energy to the rock through said rock-crushing element.

It is further preferable that the length of the wearable portion of each rock-crushing element should be chosen taking into account the following relationship:

$$H=(n-1)L$$

where

L is distance between adjacent annular grooves on lateral surface of shank of rock-crushing element, m; and $n \geqq 2$ is number of annular grooves on lateral surface of shank of rock-crushing element.

It is also of advantage that said means for fixing each rock-crushing element in a peripheral ring relative to the casing should be made as a bushing of elastic material, which encompasses said rock-crushing element and is disposed in a blind cavity within the casing, said cavity being in communication with the space between the casing and the body.

Such a design of said fixing means substantially simplifies construction of the tool and precludes its jamming in running it in and out of the borehole.

When deep holes are drilled in highly abrasive rock, it is advisable that the tool should comprise support elements secured on the end face of the casing on the side of crushed rock, the height of said support elements being equal to the sweep of the rock-crushing elements over said end face, while the means for axial displacement of the casing relative to the body is essentially a splined joint.

This provides for upward movement of the casing due to reaction of the hole bottom to the support elements as the rock-crushing elements wear out and to their exposure. Stated differently, wear of the rock-crushing elements in the course of drilling may be compensated for automatically.

It is further advantageous that each section of the end face of the body interacting in drilling with the shank of the rock-crushing element in a peripheral ring should be rectilinear and perpendicular to the longitudinal axis of said rock-crushing element.

This ensures maximal efficiency in transmitting impact energy from the body of the proposed tool to the rock-crushing elements and therethrough to the rock.

It is also preferable that the length of the section of the end face of the body interacting in drilling with the rock-crushing element in a peripheral ring should exceed the length of the section of the end face of the shank of said rock-crushing element interacting with said section of the body.

As a result, said rock-crushing elements in a peripheral ring may freely move towards the tool periphery in upward movement of the casing as said rock-crushing elements wear out, which in turn, ensures a constant tool diameter and, consequently, a constant borehole diameter.

It is further preferable that the total area of the flow section of said through channels passing a working medium and disposed in the casing should be smaller than the total area of the flow section of said through channels in the body for passing said working medium.

Due to the fact that the total area of said channels in the casing is smaller than the total area of said channels in the body, a surplus pressure is produced as the working medium is passed in the space between the body and the casing. This pressure causes the casing to move out the body and prevents spontaneous collapse of the tool in the event of friction between the borehole walls and the casing in running the tool in or out of the borehole.

BRIEF DESCRIPTION OF THE DRAWINGS

The invention will now be described in greater detail with reference to specific embodiments of the proposed percussion-rotary drilling tool, taken in conjunction with the accoppanying drawings, wherein.

BEST MODE OF CARRYING OUT THE INVENTION

Figure 1:
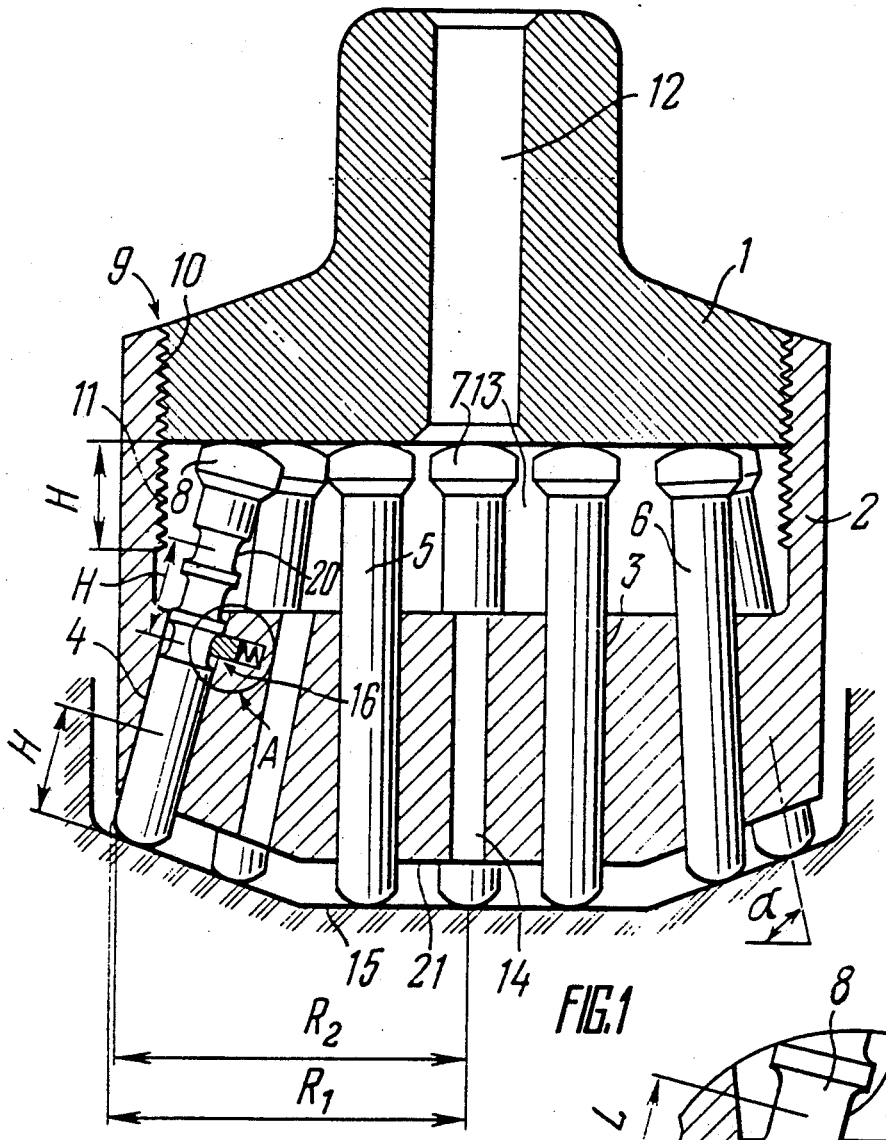
FIG. 1 shows a percussion-rotary drilling tool according to the present invention.

Referring to FIG. 1 the percussion-rotary drilling tool according to the invention comprises a body 1 designed to interact with a percussion-rotary device (not shown in the drawing) and a casing 2 shaped as a sleeve. The casing 2 accommodates central channels 3 and peripheral channels 4 representing concentric rings. The channels 3 and 4 contain rock-crushing elements 5 and 6, respectively. All the rock-crushing elements 5 and 6 have shanks 7 and 8, respectively. Said shanks interact with the end face of the body 1. The casing 2 comprises a means 9 for its axial displacement with respect to the body 1. When holes to be drilled are not deep, the means 9 is essentially a threaded joint, one of threads 10 being made on the outer laterial surface of the body 1, while the other thread 11 is provided on the inner surface of the wall of the casing 2.

To enable passage of a working medium, the body 1 has at least one through channel 12 communicating on one end with a working-medium source (not shown in the drawing) and on the other end with a space 13 between the end face of the body 1 and the inner surface of the casing 2.

Likewise the casing 2 comprises at least one through channel 14 used to pass said working medium from the space 13 to a borehole 15.

Figure 2:
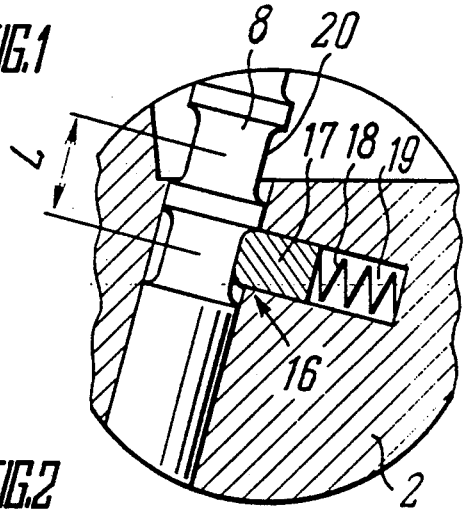
FIG. 2 is view A of FIG. 1 on an enlarged scale.

To prevent the rock-crushing elements 6 in a peripheral ring from falling out to the full length of the wearable portion in running the tool in and out of the borehole so that it is not jammed in the borehole 15, each rock-crushing element 6 in a peripheral ring comprises a means 16 (FIG. 2) enabling its fixation in the casing 2. The fixing means 16 is formed with a retaining element 17 having a spring 18 and disposed in a blind cavity 19 provided in the casing 2 and communicating with the peripheral channel 4. The retaining element 17 interacts with a respective annular groove 20 made on the lateral surface of the shank 8.

The distance L between the adjacent annular grooves 20 is chosen by reference to the relationship $$L = (0.8 - 1.0)\frac{R_1 - R_2}{\cos\alpha}$$

where $R_1$ (FIG. 1) is radius of the percussion-rotary drilling tool according to the invention, m ($R_1$ is distance from the tool axis to the point at which the rock-crushing element in a peripheral ring comes into contact with the borehole wall);

$R_2$ is the casing radius, m; and $\alpha$ is the angle of inclination of each rock-crushing element 6 in a peripheral ring towards an end face 21 of the casing 2 on the side of crushed rock.

The angle $\alpha$ should advantageously be within 45°–89° to prevent jamming of the proposed tool in the borehole 15, that is, to provide a desired gap between the wall of the borehole 15 and the tool. The lower limit of said angle ($\alpha$=45°) is chosen to ensure maximal transmission of impact energy through the rock-crushing element 8 to the rock.

The range of 0.8 to 1.0 in the above relationship is chosen from the following considerations. The upper limit (1.0) limits a maximum diameter of the borehole 15 to the diameter of the tool in drilling subsequent holes after compensating for wear of the rock-crushing elements 6. The lower limit (0.8) is chosen taking into account that, with its value below 0.8, wear would have to be compensated for too frequently with retaining element 17 (FIG. 2) transferred into the adjacent annular groove 20.

When the proposed tool includes the retaining elements 17, length H (FIG. 1) of the wearable portion of the rock-crushing elements 5 and 6 is chosen from the relatioship $$H=(n-1)L$$

where $n \geqq 2$ is the number of the annular grooves 20 on the lateral surface of the shank 8.

Stated differently, the length H of the wearable portion of the rock-crushing elements 5 and 6 is proportional to the distance L between the adjacent annular grooves 20 and depends on the number of said grooves 20, whereas in the absence of the retaining elements 17 (FIG. 2) the maximum length H (FIG. 1) of the wearable portion of the rock-crushing elements 5 and 6 is limited by a value determined from the equation $$H_{max} = \frac{R_1 - R_2}{\cos\alpha}$$

The above limitation is necessary to avoid jamming of the tool in running it in and out of the borehole.

To enable full utilization of the tool as durability of the rock-crushing elements 5 and 6 permits, the length H of the wearable portion of the rock-crushing elements 5 and 6 is made to correspond to axial displacement of the casing 2 relative to the body 1.

The percussion-rotary drilling tool forming the subject of the present invention operates in the following manner.

The tool is installed where the borehole 15 is to be drilled. Pneumatic or hydraulic percussion equipment (not shown in the drawing) is placed over the tool to transmit rotation and impact momentum thereto. An axial force is transmitted through the body 1 to the rock-crushing elements 5 and 6 bearing up against the bottom of the borehole 15, the shanks 7 and 8 being supported by the end face of the body 1. The tool is taken out of the borehole on completion of the drilling operation. The rock-crushing elements 6 disposed in the peripheral channels 4 are held from falling out to the full length of the wearable portion by the retaining elements 17, which precludes jamming of the tool in the borehole 15 in running it in and out of the borehole. The wear of the rock-crushing elements 5 and 6 occurring while the borehole 15 is drilled is compensated for by displacing the casing 2 relative to the body 1, which is done by screwing the casing 2 in the body 1 using the thread 10. The retaining elements 17 (FIG. 2) are transferred into the adjacent annular grooves 20 on the lateral surface of the shanks 8 of the rock-crushing elements 6 to compensate for the wear and obtain predetermined sweep of the rock-crushing elements 6 (FIG. 1) relative to the casing 2. Owing to the fact that the distance L (FIG. 2) between the adjacent annular grooves 20 is chosen with due regard for the above relationship, the diameter of each subsequent hole drilled by the proposed tool is essentially constant and jamming of the tool in the borehole 15 (FIG. 1) in running it in and out is prevented, regardless of the length H of the wearable portion of the rock-crushing elements 6.

Figure 3:
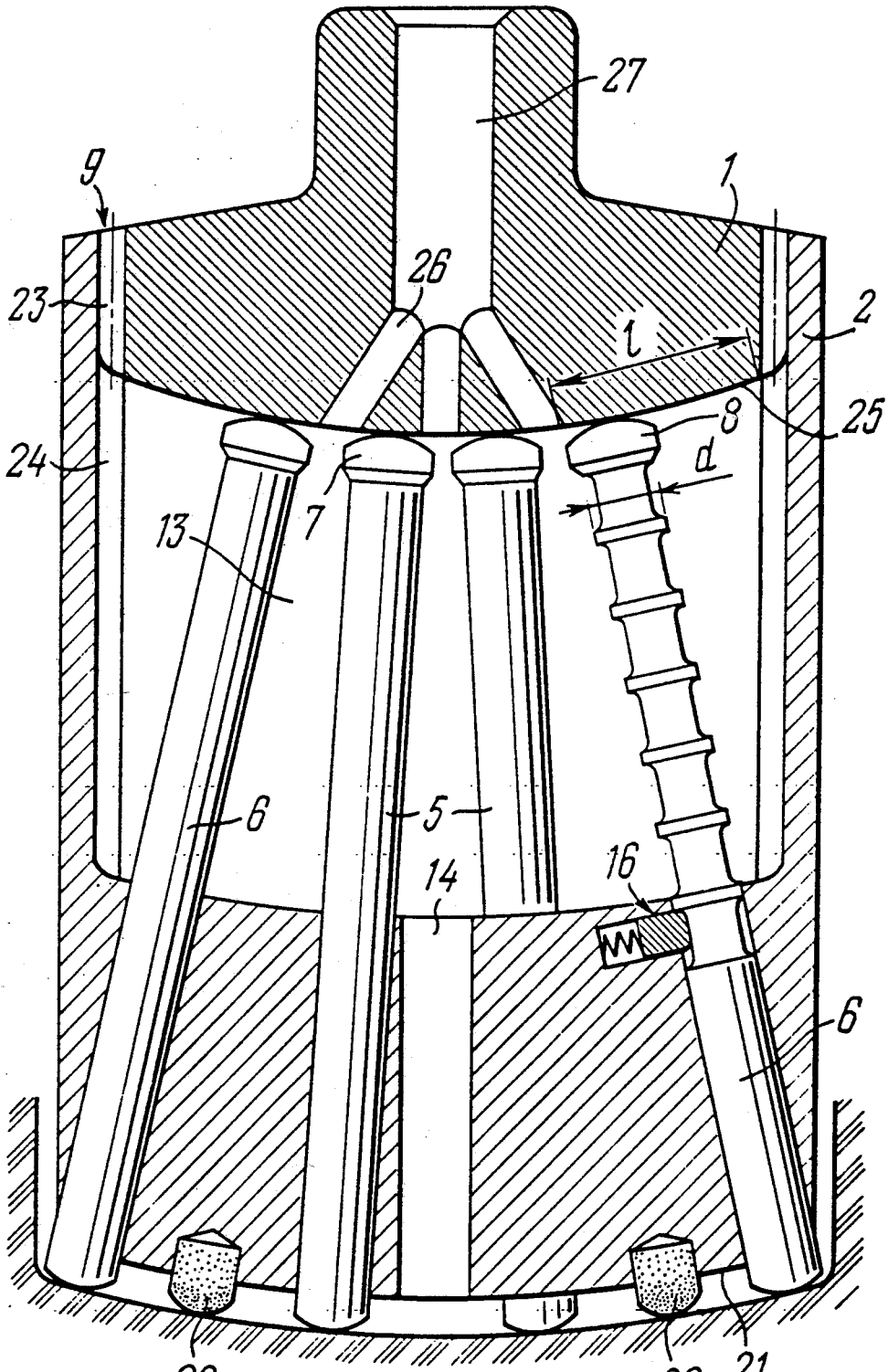
FIG. 3 depicts the percussion-rotary drilling tool in compliance with the present invention with a splined joint between the casing and the body.

When deep holes are to be drilled in highly abrasive rock by the use of the proposed tool, the end face 21 of the casing 2 is fitted with support elements 22 (FIG. 3) whose height is equal to the sweep of the rock-crushing elements 5 and 6 over the end face 21. To ensure upward movement of the casing 2 due to reaction of the borehole bottom to the support elements 22 as the rock-crushing elements 5 and 6 wear out, use is made of the means 9 for axial displacement of the casing 2 relative to the body 1, said means representing a splined joint formed by slots 23 on the outer lateral surface of the case and projections 24 on the inner surface of the walls of the casing 2.

Each section 25 of the end face of the body 1 interacting in drilling with the shank 8 of the respective rock-crushing element 6 in a peripheral ring is rectili-near and perpendicular to the longitudinal axis of the rock-crushing element 6. Such an end face of the body 1 permits obtaining maximum efficiency in transmitting impact energy from the body 1 to the rock-crushing elements 5 and 6 and therethrough to the rock. Each section 25 has length l exceeding length d of the section of the end face of the shank 8 of the rock-crushing element 6. Thus, the rock-crushing elements 6 in a peripheral ring may freely move towards the periphery of the tool in upward movement of the casing 2 as the rock-crushing elements 5 and 6 wear out, which, in turn, ensures a constant diameter of the tool and, in effect, a constant diameter of the borehole 15. To provide for uniform feed of a working medium into the space 13 between the body 1 and the casing 2, the body 1 includes several peripheral channels 26 communicating on one end via a channel 27 with a working-medium source (not shown in the drawing) and on the other end with the space 13 between the body 1 and the casing 2. To produce a surplus pressure in the space 13 so that the casing 2 may move out of the body 1, the total area of the flow section of the channels 26 is chosen to exceed the total area of the flow section of the through channels 14 in the casing 2. The action of said surplus pressure prevents spontaneous collapse of the tool in the event of friction between the walls of the borehole 15 and the casing 2 in running the tool in and out of the borehole.

Operation of the preferred embodiment of the percussion-rotary drilling tool is as follows.

Before the drilling operation begins, the casing 2 moves out of the body 1 to a maximum length by gravity or under the action of the surplus pressure. The rock-crushing elements 5 arranged in the central ring and having no means 16 for fixation in the casing 2 move out of the casing to the full length of the wearable portion. When the tool is placed on the borehole bottom, the rock-crushing elements 5 are sunk in the casing 2 until their shanks 7 come in contact with the end face of the body 1 and the casing 2 bears up against the bottom with its support elements 22. In such a position, the sweep of all the rock-crushing elements 5 and 6 is equal to the height of the support elements 22. The tool receives the axial force, torque and impact momentum from pneumatic or hydraulic percussion equipment (not shown in the drawing) arranged over it. Under the action of the above loads, the rock-crushing elements 5 and 6 penetrate the rock which is broken as the borehole 15 is drilled. As drilling proceeds, the rock-crushing elements 5 and 6 wear out in height. As a result, reaction of the borehole bottom to the support elements 22 of the casing 2 increases and the casing 2 moves upwards due to which the rock-crushing elements 5 and 6 are exposed. During upward movement of the casing 2, the rock-crushing elements 6 are displaced towards the periphery of the tool, which ensures a constant diameter of the tool and, in effect, a constant diameter of the borehole 15. Thus, a splined joint between the casing 2 and the body provides for automatic compensation of wear of the rock-crushing elements 5 and 6 in the course of drilling, a feature increasing effectiveness of the tool in operation.

Figure 4:
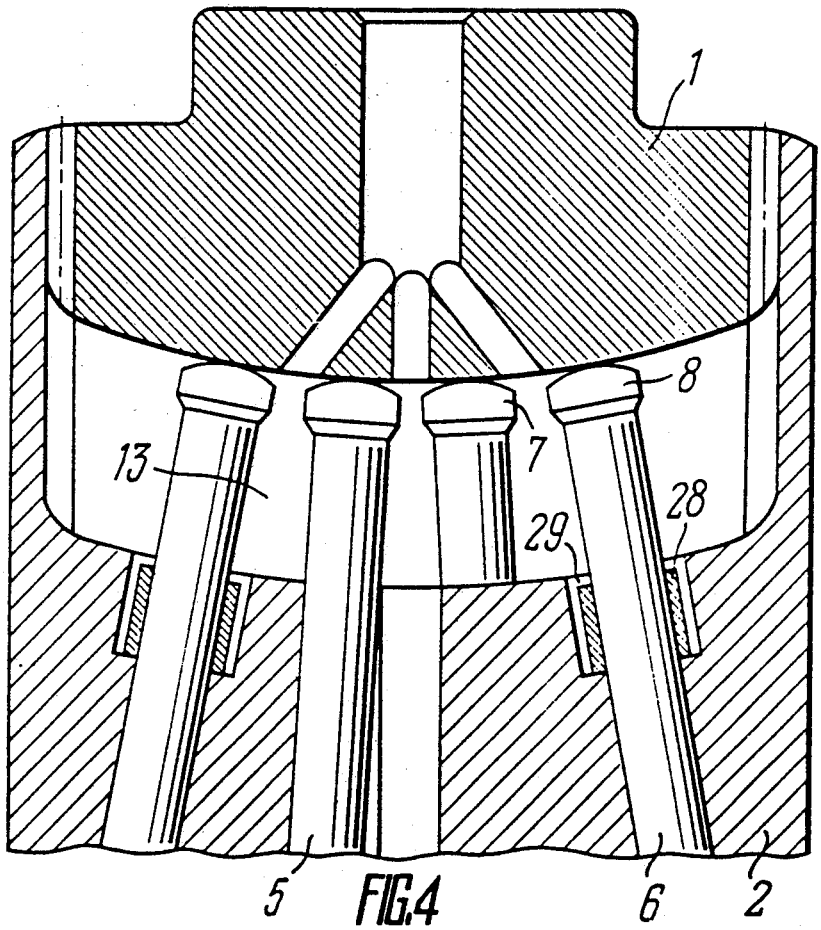
FIG. 4 is a fragmentary view of the proposed percussion-rotary drilling tool with a bushing of elastic material used as a means for fixing a rock-crushing element in a peripheral ring.

To simplify construction of the proposed tool and prevent its jamming in running in and out of the borehole 15, use may be advantageously made of the means 16 for fixing each rock-crushing element 6 in a peripheral ring relative to the casing 2, said fixing means being formed with a bushing 28 (FIG. 4) of a suitable elastic material. The bushing 28 encompassing the rock-crushing element 6 is arranged within the casing 2 in a blind circular cavity 29 communicating with the space 13 between the casing 2 and the body 1. The tool comprising the bushings 28 operates in a manner similar to that described above.

Thus, the percussion-rotary drilling tool according to the invention permits axial displacement of the casing relative to the body to the length of the wearable portion of the rock-crushing elements, an advantage appreciably increasing said length and durability of the tool.

Moreover, in the proposed tool a movable joint between the casing and the body allows automatic compensation of wear of the rock-crushing elements in drilling, a feature substantially enhancing effectiveness in operation of the percussion-rotary drilling tool.

INDUSTRIAL APPLICABILITY

The tool according to the invention may be used to fest advantage for drilling flast and prospecting holes and oil wells in highly abrasive hard rock.

We claim:

1. A percussion-rotary drilling tool comprising a body (1) designated to interact with a percussion-rotary device and having at least one through channel (12) to pass a working medium used for removing slime from a borehole (15) and a casing (2) shaped as a sleeve with a working end and having through holes situated along concentric circles, said through holes accomodating rock-crushing elements (5,6) arranged in a manner allowing axial displacement thereof, portions of said rock-crushing elements (5,6) extending beyond said working end of the casing (2) and situated along one of the concentric circles forming a separate concentric row, said rock-crushing elements (5,6) having shanks (8,7) interacting with the body (1), said casing including a means (9) for its axial displacement with respect to the body (1) and having at least one through channel (14) to pass a working medium used for removing slime from the borehole (15), characterized in that each rock-crushing element (6) in the row being the most remote from the axis of the casing (2) comprises a means (16) for fixing it in the casing (2), and the length of axial displacement of the casing relative to the body (1) is at least equal to the length (H) of the wearable portion of the rock-crushing element (6).

2. A tool as claimed in claim 1, characterized in that annular grooves (20) are provided on the lateral surface of the shank (8) of each rock-crushing element (6) in the row being the most remote from the axis of the casing, while the means (16) for fixing the rock-crushing element (6) is essentially a spring-loaded retaining element (17) interacting with the annular groove (20) and disposed in a blind capacity (19) made in the casing (2) and communicating with a peripheral channel (4) accommodating the rock-crushing element (6).

3. A tool as claimed in claim 2, characterized in that distance (L) between the adjacent grooves (20) on the lateral surface of the shank (8) of the rock-crushing element (6) is chosen from the equation $$L = (0.8 - 1.0)\frac{R_1 - R_2}{\cos\alpha}$$

where $R_1$ is radius of the proposed percussion-rotary drilling tool, m;

$R_2$ is the casing radius, m; and $\alpha$ is the angle of inclination of each rock-crushing element in the row being the most remote from the axis of the casing (2) towards the end face of the casing on the side of broken rock, $\alpha$ being within an interval from 45° to 89°.

4. A tool as claimed in claim 3, characterized in that length (H) of the wearable portion of each rock-crushing element (5, 6) is chosen from the equation $$H=(n-1)L$$

where

L is the distance between the adjacent annular grooves on the lateral surface of the shank of the rock-crushing element, m ; and $n \geqq 2$ is the number of annular grooves on the lateral surface of the shank of the rock-crushing element.

5. A tool as claimed in claim 1, characterized in that the means (16) for fixing the rock-crushing element (6) is formed with a busing 28 of a suitable elastic material which encompasses the rock-crushing element (6) and is contained within the casing (2) in a blind circular cavity (29) communicating with a space (13) between the casing (2) and the body (1).

6. A tool as claimed in claim 1, characterized in that an end face (21) of the casing (2) mounts support elements (22) on the side of crushed rock, the height of said support elements being equal to the sweep of the rock-crushing elements (5, 6) over the end face (21), while the means (9) for axial displacement of the casing (2) relative to the body (1) is essentially a splined joint.

7. A tool as claimed in claim 1, characterized in that each section (25) of the end face of the body (1) interacting in drilling with the shank (8) of the rock-crushing element (6) in the peripheral ring is rectilinear and perpendicular to the longitudinal axis of the rock-crushing element (6).

8. A tool as claimed in claim 7, characterized in that length (1) of the section (25) of the end face of the body (1) interacting in drilling with rock-crushing element (6) in the row being the most remote from the axis of the casing exceeds length (d) of the section of the end face of the shank (8) of the rock-crushing element (6), which interacts with the section (25) of the body (1).

9. A tool as claimed in claim 6, characterized in that the total area of the flow section of the through channels (14) designed to pass a working medium and found in the casing (2) is smaller than the total area of the flow section of the through channels (12) designed to pass said working medium and provided in the body (1).

* * * * *